United States Patent [19]

Stritzke

[11] Patent Number: 4,763,618

[45] Date of Patent: Aug. 16, 1988

[54] VALVE STEM OIL DEFLECTOR

[75] Inventor: Bernard G. Stritzke, Hanover Park, Ill.

[73] Assignee: Microdot Inc., Darien, Conn.

[21] Appl. No.: 33,786

[22] Filed: Apr. 3, 1987

[51] Int. Cl.[4] ..... F01L 3/24

[52] U.S. Cl. ..... 123/188 P

[58] Field of Search ..... 123/188 VA, 188 P; 277/152

[56] References Cited

U.S. PATENT DOCUMENTS

| | | | |
|---|---|---|---|
| 1,344,347 | 6/1920 | Lee | 123/188 P |
| 1,370,346 | 3/1921 | Nelson | 123/188 P |
| 1,481,562 | 1/1924 | Rowe | 123/188 P |
| 3,403,918 | 10/1968 | Liebig | 277/152 |
| 3,492,982 | 2/1970 | Norris | 277/152 |
| 3,554,180 | 1/1971 | Lesser | 123/188 P |
| 3,771,800 | 11/1973 | Wilson et al. | 123/188 P |
| 4,124,220 | 11/1978 | Leone et al. | 123/188 P |
| 4,134,596 | 1/1979 | Kawai et al. | 277/152 |
| 4,198,062 | 4/1980 | Grzesiak | 123/188 P |

FOREIGN PATENT DOCUMENTS

| | | | |
|---|---|---|---|
| 2145771 | 4/1985 | United Kingdom | 123/188 P |

*Primary Examiner*—Willis R. Wolfe
*Assistant Examiner*—M. Macy
*Attorney, Agent, or Firm*—Lyman R. Lyon

[57] ABSTRACT

An oil deflector adapted to be mounted on the stem of a valve of an internal combustion engine comprises a generally cup-shaped molded plastic member having a generally cylindrical section and a transversal end wall section having a bore with a radially inwardly opening groove for the acceptance of an O-ring.

1 Claim, 1 Drawing Sheet

VALVE STEM OIL DEFLECTOR

BACKGROUND OF THE INVENTION

Valve stem seals for internal combustion engines are subjected to extremely destructive environmental conditions including repeated heating and cooling cycles. These, along with the resulting material shrinkage that may occur, result in high internal stress conditions that historically have been the source of premature failure.

SUMMARY OF THE INVENTION

The invention relates to a high strength, fracture resistant, inexpensively manufactured, easily assembled, molded thermoplastic valve stem oil deflector for an internal combustion engine.

The oil deflector comprises a cup-shaped member with an enlarged neck that the valve stem at two axially spaced positions. The neck has a bore with a radially inwardly opening annulus in the wall thereof for the acceptance of an O-Ring, quadring, square-cut, or eqivalent seal that seals on the valve stem. Circumferentially spaced teeth are provided on the inside of the bore to prevent tipping of the deflector on the valve stem.

DESCRIPTION OF THE INVENTION

Figure 3:
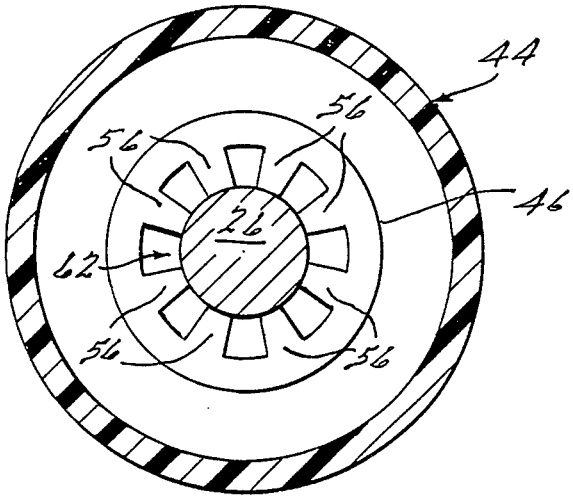
FIG. 3 is a cross section along the line 3—3 of FIG. 2.
Figure 1:
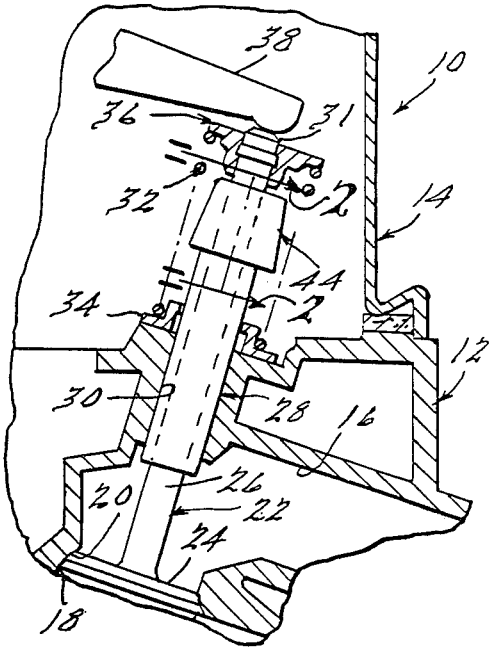
FIG. 1 is a fragmentary cross sectional view of a portion of a conventional internal combustion engine having a two piece oil deflector in accordance with a preferred embodiment of the present invention.
Figure 2:
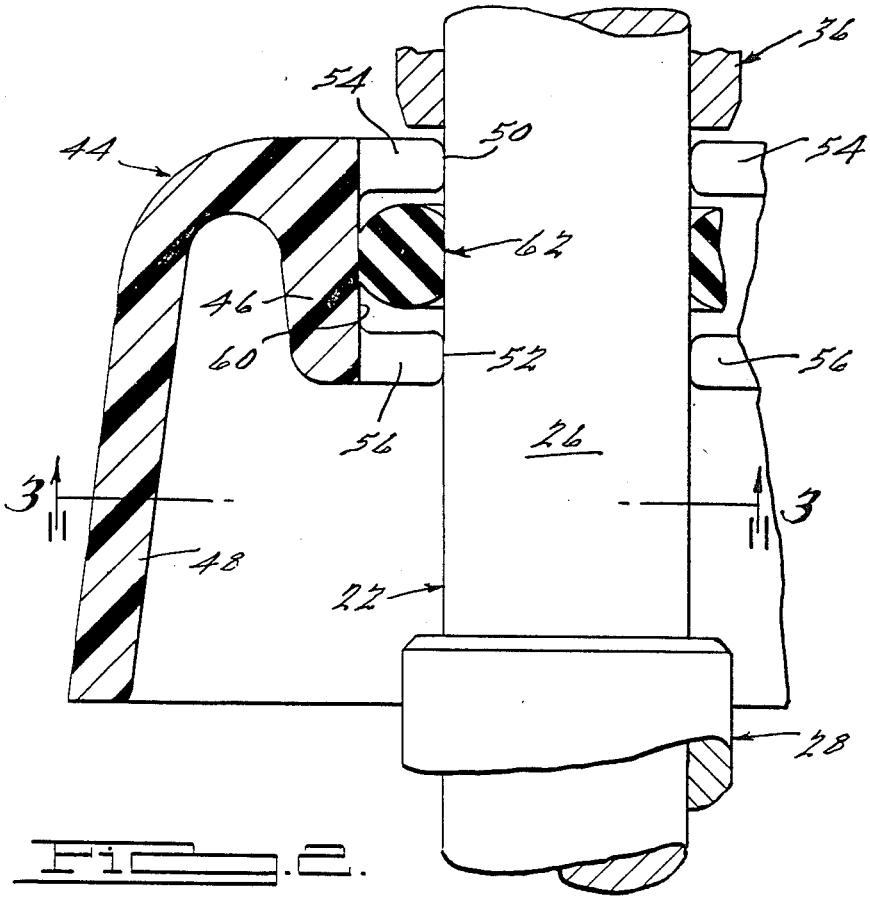
FIG. 2 is an enlarged cross sectional view taken substantially along the line 2—2 of FIG. 1.

Referring to FIG. 1 of the drawing, a conventional internal combustion engine 10 comprises a cylinder head 12 having a rocker arm cover 14 mounted thereon. The cylinder head 12 is provided with a passage 16 that communicates with an intake or exhaust manifold (not shown) and a combustion chamber 18. The lower end of the passage 16 is provided with an annular valve seat 20 for seating of a conventional valve 22 having a head portion 24. The valve 22 has a stem section 26 that reciprocates in a valve guide 28 which is supported within a bore 30 in the cylinder head 12.

An upper end 31 of the valve stem 26 is surrounded by a helical compression spring 32 which is supported at the lower end thereof by an annular bushing or spring locator 34 coaxially dispersed about the valve guide 28 and bearing against the cylinder head 12. The upper end of the spring 32 abuts against a spring retainer 36. A rocker arm 38 bears against the upper end 31 of the valve stem 26 and is adapted to effect reciprocal movement of the valve 22 in a manner well known in the art.

In accordance with the present invention, the valve 22 is provided with a cup-shaped oil deflector generally designated by the numeral 44. The deflector 44 is made of a molded plastic material which is relatively stiff, dimensionally stable, and resistant to heat up to at least approximately 350° F. One preferable material is glass filled Nylon which has been found to have the requisite heat resistant characteristics. However, it will be apparent that equivalent materials can be used in fabricating the deflector 44 of the present invention noting that the material should be one that does not exhibit dimensional change expansion due to heating and cooling.

The oil deflector 44 comprises an enlarged central neck, portion 46 and a skirt portion 48 which flares outwardly toward the bottom end thereof. The neck portion 46 is provided with axially aligned and longitudinally spaced apertures 50 and 52 having circumferentially spaced teeth 54 and 56, respectively, and which are spaced by an annulus 60. The teeth 54 and 56 preclude tipping of the oil deflector 44 relative to the valve stem 26.

The annulus 60 is located between the axially spaced teeth 54 ad 56 for the acceptance of an O-ring 62 which effects sealing of the deflector 44 on the valve stem 26.

The oil deflector 44 is assembled upon the valve stem 26 of the valve 22 prior to assembly of the compression spring 32 and its associated parts. The deflector 44 is initially disposed adjacent to the guide 28. The first time the valve 22 is moved to the open position (downwardly), the bottom of neck 46 on the deflector 44 engages the upper end of the valve guide 28 so that the deflector 44 is forced axially along the valve stem 26 to a position that is permanently assumed on the valve stem 26. In this position, the bottom of the skirt 48 on the deflector 44 is at all times below the top of the guide 28 as seen in FIG. 1.

In operation, the valve stem oil deflector 44 deflects lubricating oil and spray within the valve cover 14 away from the upper end of the valve guide 28, thereby preventing oil from entering into the combustion chamber 18 of the engine 10. Because of the tight sealing engagement of the "O"-ring 62 against the outer periphery of the valve stem 26 and the inner periphery of the annulus 60 in the deflector 44, oil cannot flow downwardly between the deflector 44 and the valve stem 26.

While the preferred embodiment of the invention has been disclosed, it should be appreciated that the invention is susceptible of modification without departing from the scope of the following claims.

I claim:

1. An oil deflector for attachment to a valve stem of an internal combustion engine or the like comprising a molded plastic cup having a generally cylindrical wall section and an enlarged transversely extending end wall defining a neck portion, having an opening for receiving a valve stem, a radially inwardly opening annular groove on an inner face of said opening in said neck portion, an O-ring in said groove, a plurality of circumferentially spaced teeth on opposite sides of said groove each of which is engageable with a valve stem extending through the neck portion of said deflector to preclude tipping of said deflector relative to the valve stem.

* * * * *